United States Patent [19]

Rodskier

[11] Patent Number: 5,046,977

[45] Date of Patent: Sep. 10, 1991

[54] EXHAUST MUFFLER FOR MARINE ENGINES

[75] Inventor: Christian Rodskier, Torslanda, Sweden

[73] Assignee: AB Volvo Penta, Goteborg, Sweden

[21] Appl. No.: 455,506

[22] Filed: Dec. 15, 1989

[30] Foreign Application Priority Data

Jan. 4, 1989 [SE] Sweden ..... 8900025

[51] Int. Cl.[5] ..... B63H 21/32

[52] U.S. Cl. ..... 440/89; 181/221; 181/238

[58] Field of Search ..... 440/88, 89; 181/221, 181/235, 238, 240, 260, 264, 212, 239, 259, 268; 60/272, 310

[56] References Cited

U.S. PATENT DOCUMENTS

| | | | |
|---|---|---|---|
| 2,940,249 | 6/1960 | Gospodar | 440/89 |
| 4,422,519 | 12/1983 | Nomura et al. | 181/238 |
| 4,713,029 | 12/1987 | Ford | 60/32 |

FOREIGN PATENT DOCUMENTS

| | | |
|---|---|---|
| 0280422 | 8/1988 | European Pat. Off. . |
| 732466 | 3/1943 | Fed. Rep. of Germany . |

*Primary Examiner*—Ed Swinehart
*Attorney, Agent, or Firm*—Young & Thompson

[57] ABSTRACT

An exhaust muffler for marine engines comprises a cylindrical container arranged to be mounted with its longitudinal axis horizontal and traverse to the longitudinal axis of the engine. The container forms an expansion chamber, which is closed at one or both ends by an end piece (23) depending of whether it is used on engines with one or two rows of cylinders. The end piece has an inlet (26) and an outlet (27) for exhaust gas and intermediate flow diverting baffles (50,51).

11 Claims, 4 Drawing Sheets

EXHAUST MUFFLER FOR MARINE ENGINES

The present invention relates to an exhaust muffler for marine engines, comprising a container with an inlet and an outlet for exhaust and cooling water, and with flow diverting means disposed between the inlet and the outlet.

BACKGROUND OF THE INVENTION

In a type of muffler which is common in exhaust systems for marine engines, there is a container with a water trap, mounted upright, usually beside the engine. In order to make the noise muffling effective without increasing the counter pressure to an unacceptably high level, these containers must be made relatively large. An in-line engine with a power of 150–200 horsepower can require a container with a diameter of 200 mm and a height of over 500 mm in order to achieve a noise level which is sufficiently low to meet environmental standards. A 300 horsepower V-engine thus requires two such containers which, when mounted beside each row of cylinders, take up a great amount of space in the engine room. This reduces accessability for service and repairs. The problems are particularly great in power plants with twin V-engines. This type of muffler installation generally requires relatively long tubing with many bends.

SUMMARY OF THE INVENTION

The purpose of the present invention is in general to achieve a muffler which is so designed that it is, on the one hand, less space consuming than the above described known type and, on the other hand, can be mounted within a space in the engine room which is normally not used for other components in the power plant. A particular purpose is to achieve an exhaust muffler for marine engines with twin rows of cylinders which, without sacrificing muffling effect or increasing the counter pressure, can be made substantially smaller than two mufflers of the known type described, and which can also be installed with the shortest possible tubing within a space which is often not used for other purposes.

This is achieved according to the invention in an exhaust muffler of the type described by way of introduction by virtue of the fact that the container is arranged to be mounted with its longitudinal axis horizontal and transverse to the longitudinal axis of the engine, that an inlet for exhaust and cooling water from a row of cylinders is disposed at or near one end of the container, that the mixture of exhaust gas and water is introduced at least essentially horizontally and perpendicular to the longitudinal axis of the container and that the flow diverting means are made so that the mixture is diverted horizontally in the longitudinal direction of the container and is directed upwards and then downwards before reaching the outlet.

Such a "horizontal" container can be mounted behind the engine above the fly-wheel cover between the engine block and the boat transom. Such a placement also has the advantage that the exhaust tubing from the engine exhaust manifold of one row of cylinders can be made very short and in certain cases without any bends.

The exhaust muffler according to the invention was originally developed for engines with double rows of cylinders, and an elongated container common to both cylinder rows was used with an exhaust inlet at each end. Tests proved, surprisingly, that it was sufficient that this container had a volume of approximately half of the combined container volume in the known exhaust muffler system with a vertical container for each row of cylinders, in order to achieve muffling to a level that was actually lower than what could be achieved with the known system. This result could be achieved without any power sacrificing increase in the exhaust counter pressure. Tests performed with corresponding separate mufflers for each row of cylinders, i.e. with two separate containers, each with one closed end and an inlet and outlet at the opposite end, showed quite surprisingly that the muffling at high engine speed was as good as the muffler with a common container for both cylinders, even when the combined volume of the separate containers was reduced to about 70% of the volume of the latter. The noise level when using separate containers with reduced volume was, however, higher at lower engine speeds.

BRIEF DESCRIPTION OF THE DRAWINGS

The invention will be described in more detail below with reference to the accompanying drawings, where.

DESCRIPTION OF THE PREFERRED EMBODIMENTS

Figure 1:
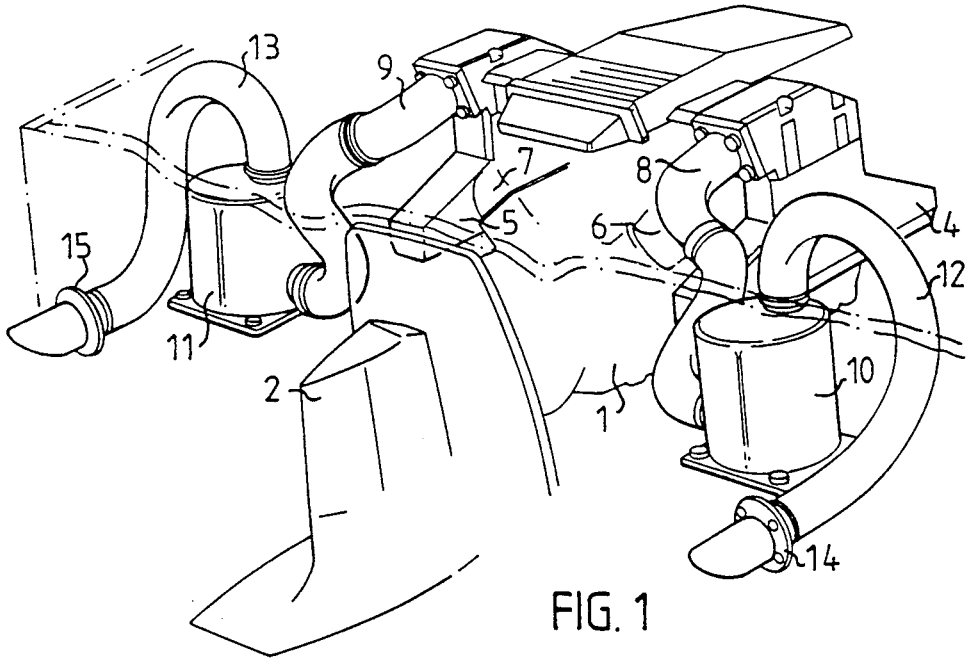
FIG. 1 PRIOR ART
FIG. 1 shows a schematic perspective view of a previously known exhaust muffler installation for a V-engine.

In FIG. 1, 1 designates a V-engine, for example a V-8, which is coupled to an outboard drive 2, e.g. an Aquamatic drive ®, outside a boat transom 3. Exhaust tubes or pipes 8, 9 lead exhaust and cooling water to upright cylinder muffler containers 10, 11 containing sound-muffling means with so-called "aqualift" from exhaust manifolds 4, 5 on each row of cylinders 6, 7. The tubes 8, 9 extend horizontally into the lower portion of each container 10, 11. The exhaust tubes 12, 13 extend first vertically upwards from the upper end of each container and are then bent to extend horizontally into pipe stubs 14, 15, which extend beyond the transom of the boat. The installation shown in FIG. 1 requires, as is evident from the Figure, a relatively large space on either side of the engine and long exhaust tubes. The installation as a whole is therefore quite space consuming.

Figure 2:
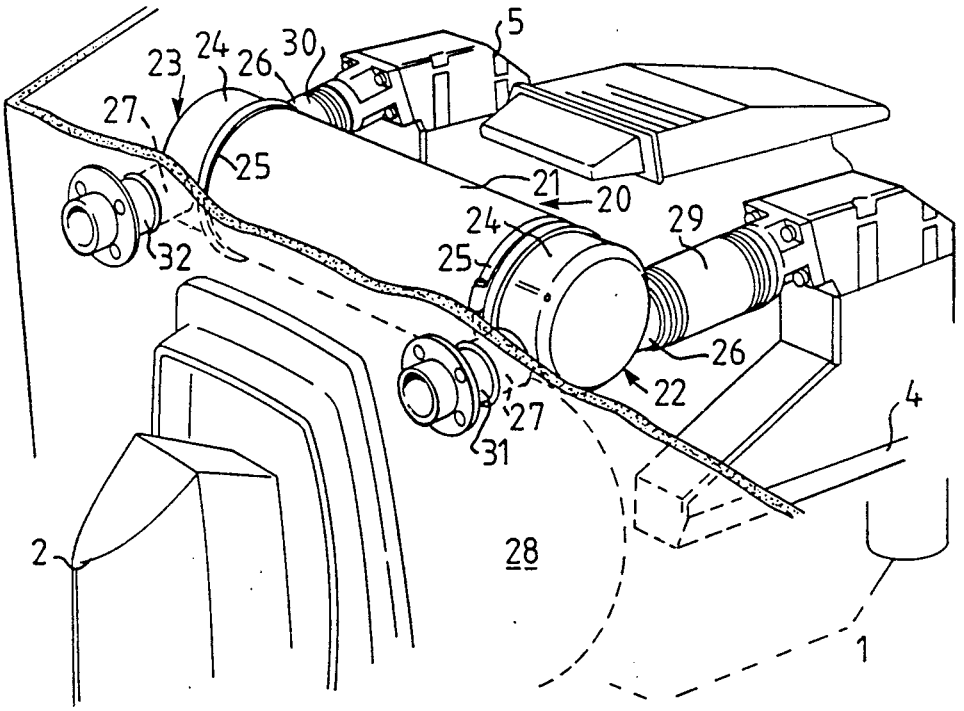
FIG. 2 shows a schematic perspective view of a first embodiment of a muffler according to the invention for a V-engine.

FIG. 2 shows a first embodiment of an exhaust muffler according to the invention for a V-engine. The two containers in the known design shown in FIG. 1 have been replaced here with a single container 20 common to both rows of cylinders of the engine 1 This common container 20 is cylindrical and consists of a tubular intermediate portion 21 and two end pieces 22, 23. The intermediate portion is suitably made of elastic material, e.g. reinforced rubber, and the end pieces of metal. The end pieces 22, 23 have cylindrical portions 24, the outer diameter of which is equal to the inner diameter of the intermediate portion 21, so that the latter can be forced over the end pieces and secured thereto with hose clamps 25.

This construction makes it possible to simply adapt the length of the container to the distance between the exhaust manifold outlets. In principle it is possible to keep in stock only one type adapted to the largest engine type. This can be used for smaller engines by cutting the intermediate portion to a suitable length when installing it. The intermediate portion 21 is thus entirely empty, while the end pieces 22, 23 contain flow-diverting baffles with a water trap between an inlet 26 and an outlet 27, as will be described below with reference to FIG. 5.

As is evident from a comparison of the installations in FIGS. 1 and 2, the latter does not require any space beside the engine. The entire exhaust muffler container 20 can be placed between the transom 3 and the engine block above the fly-wheel casing indicated at 28. The exhaust tubes 29, 30 from the engine to the container 20 and the tubes 31, 32 from the container to the exhaust pipes in the transom can be made straight and short as shown in FIG. 2.

Figure 3:
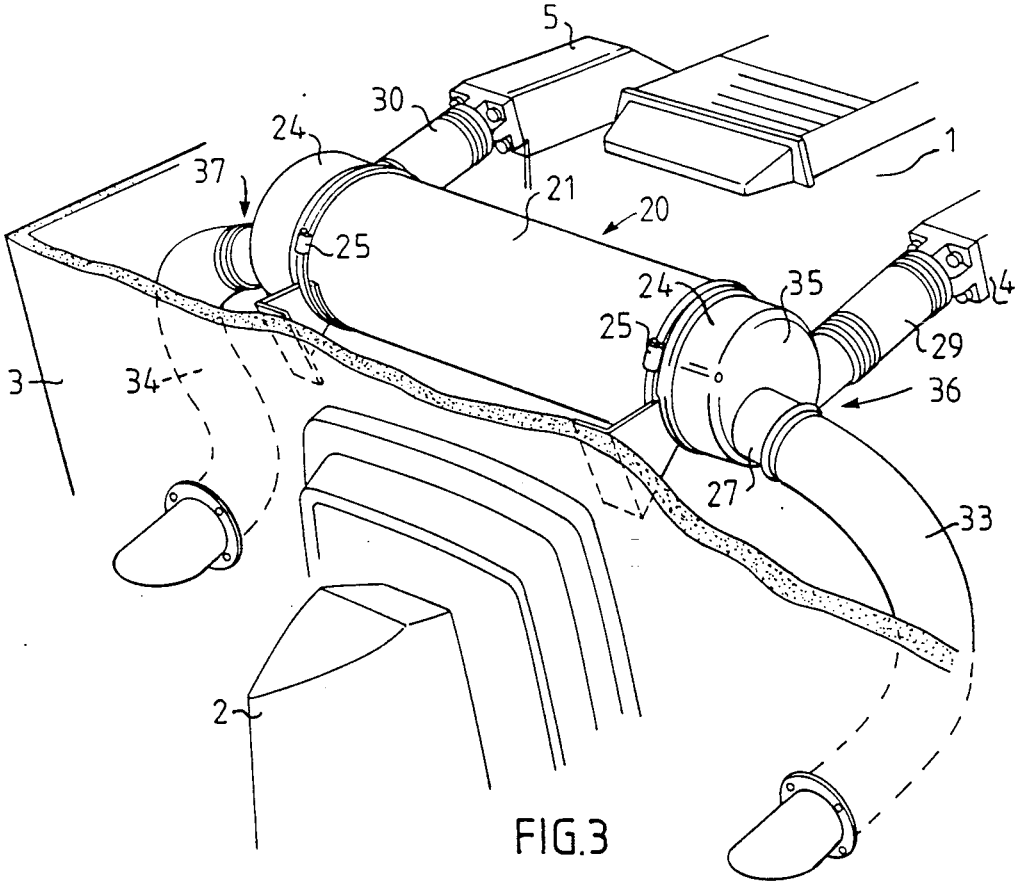
FIG. 3 is a view corresponding to FIG. 2 of a second embodiment.

FIG. 3 shows an embodiment of an exhaust muffler installation according to the invention which differs from that described above only in that the exhaust tubes 33 from the container 20 to the exhaust pipes in the transom 3 extend from the end walls 35 in the somewhat modified end pieces 36, 37.

Figure 4:
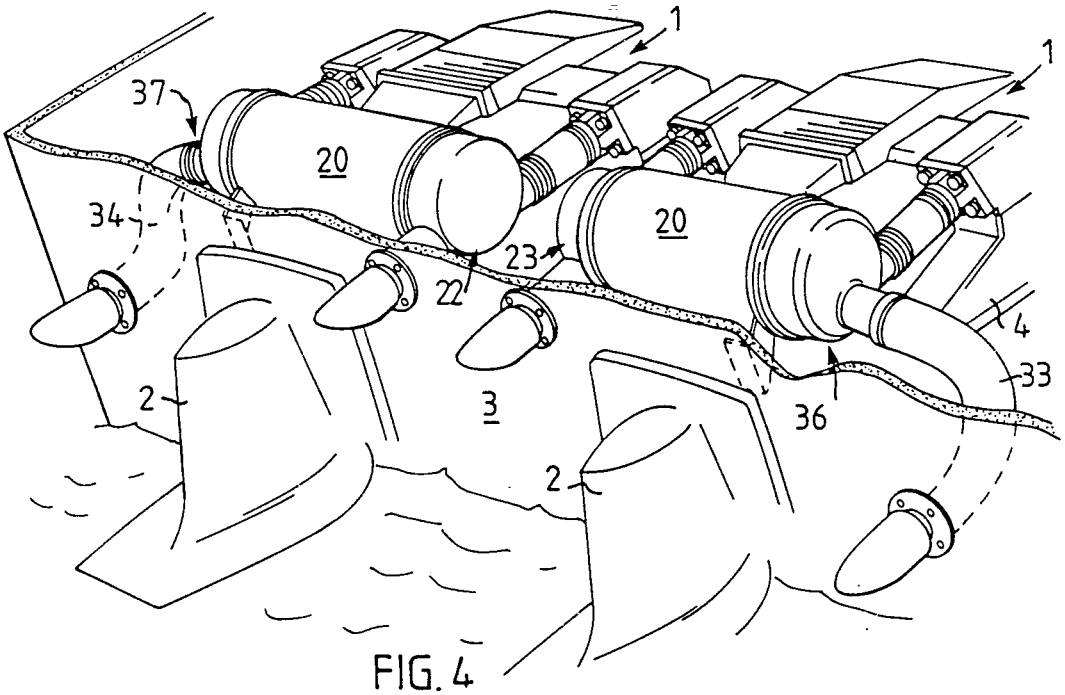
FIG. 4 shows a twin engine power plant with two exhaust mufflers in a third embodiment for V-engines.

FIG. 4 shows a twin engine power plant with two muffler installations, which combine the embodiments shown in FIGS. 2 and 3. The engines are here provided with individual muffler containers 20, which at their ends facing each other have end pieces 22, 23 of the type shown in FIG. 2, i.e. with inlet and outlet in line with each other. The ends of the containers 20 facing away from each other have end pieces of the type shown in FIG. 3, i.e. with an exhaust outlet 33, 34 in the end wall 35 of the respective end piece. As is evident from the Figures, the arrangement according to the invention provides great flexibility with the possibility of exceptionally compact installation, particularly for twin engine power plants.

Figure 5:
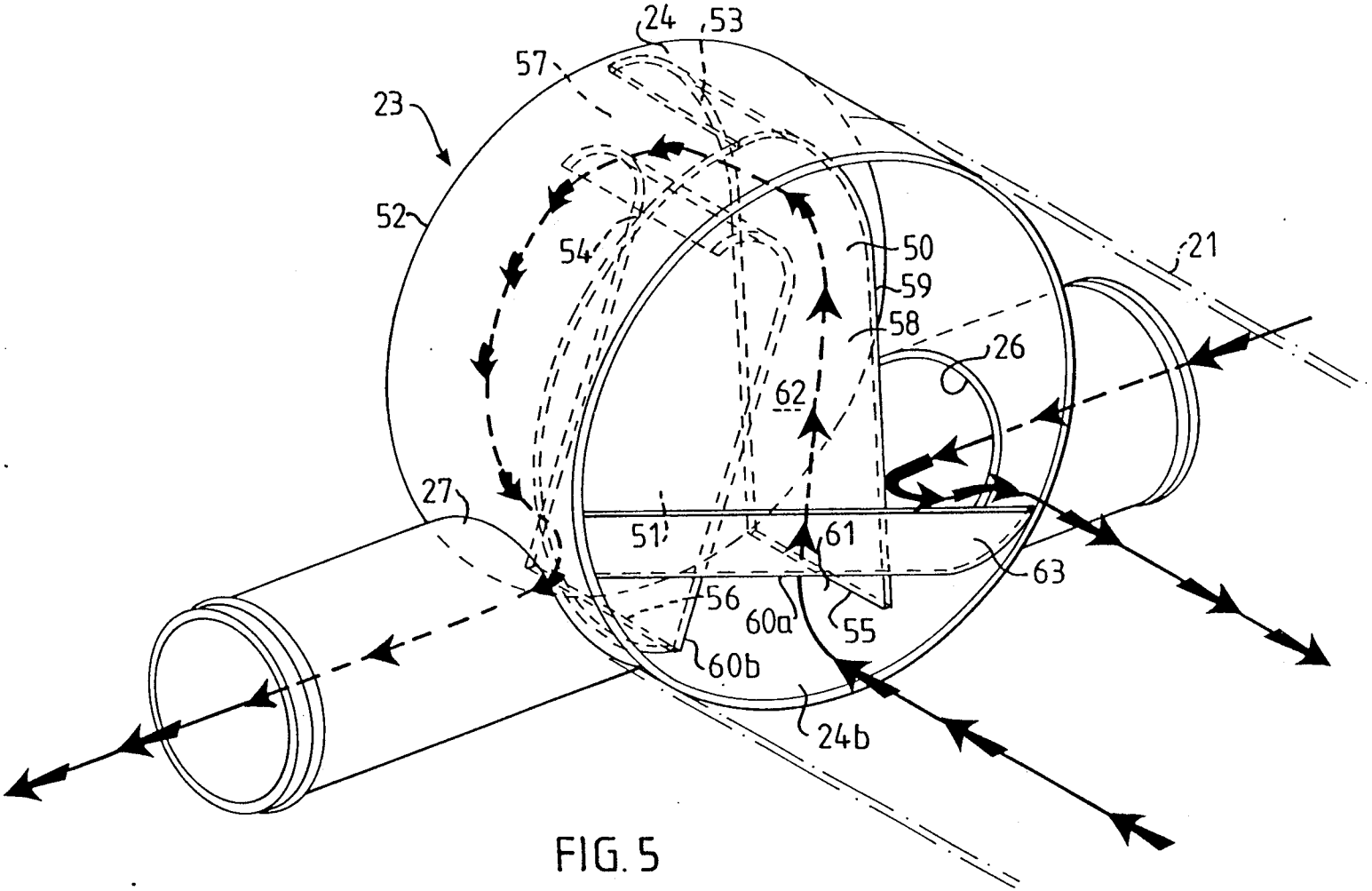
FIG. 5 is a perspective view of an end piece.

FIG. 5 shows an end piece 23 which has been removed from the cylindrical intermediate portion 21 of the container. Inside the cylindrical portion 24 of the end piece 23 a pair of baffle elements 50, 51 are welded, and both of them have their outer edges 53 and 54, respectively, in contact with the end wall 52 of the end piece and have their lower edges 55 and 56, respectively, in contact with the inner surface **24*b* of the cylindrical portion 24. The baffle element 50 is placed right in front of the inlet 26 and extends up to the inner surface 24*b* of the cylindrical portion, while the baffle 51 is arranged right in front of the outlet 27 and terminates somewhat below the surface 24*b* in order to form a passage 57. A plate 58 is fixed to the baffle elements 50, 51 and extends from the inner edge 59 of the element 50 to the cylindrical surface 24*b*. The lower edge 60*a*, 60*b* of the plate 58 is shaped so that an inlet 61 to a passage 62 is defined by baffle elements 50 and 51, end wall 52 and the plate 58. A slightly curved edge piece 63 is fixed to the upper edge of the passage 62**.

The flow direction of the mixture of exhaust and cooling water is indicated in FIG. 5 with arrows. As is evident from the Figure, the incoming mixture first strikes the baffle 50 and is diverted horizontally to the interior of the container. It is thereafter forced through the inlet 61 into the passage 62 and out through the passage 57 in order to flow via the space between the cylindrical portion 24 and the element 51 out through the outlet 27.

Figure 6A:
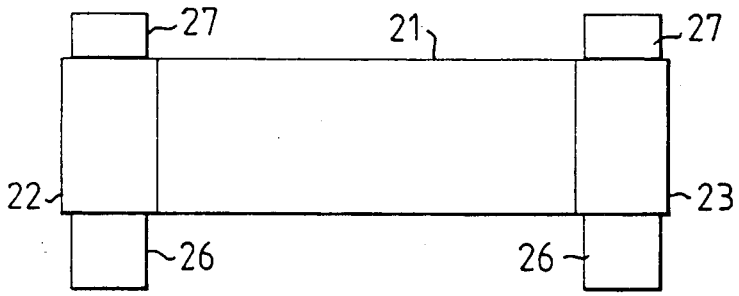
FIGS. 6A, 6B and 6C shows schematically plan views of three different embodiments of muffler containers.

Comparative trials have been done with various mufflers in a 21 foot "daycruiser" motorboat with 300 horsepower V-8 engine. The noise measurements were made with a microphone placed 15 m from a boat passing at a speed of 47–48 knots. A known system of the type shown in FIG. 1 with two upright containers, each with a diameter of 250 mm and a height of 530 mm, produced a noise level of 79.5 dB(A). A system according to the invention of the type shown in FIGS. 2 and 6A with a total length (including end pieces) of 800 mm and a diameter of 200 mm provided a noise level of 78.5 dB(A). Thus a somewhat lower noise level is obtained with the system according to the invention, the total volume of which is less than half of that of the known system.

Figure 6B:
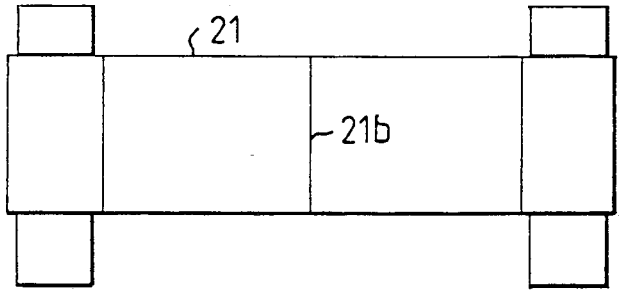
Figure 6C:
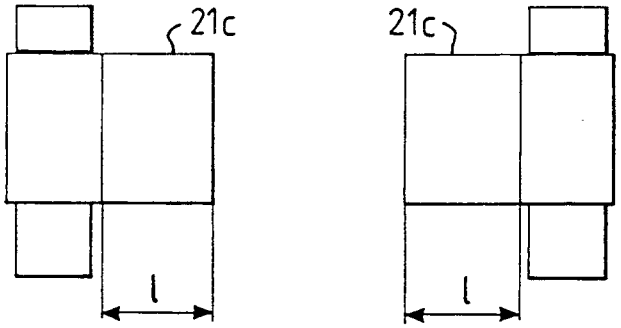

Tests under the same conditions were also done with a dividing wall **21*b* installed in the container portion 21, as shown in FIG. 6B, and with separate containers 21*c* as shown in FIG. 6C. In the latter case, containers were tested, having portions 21*c* with a length of 200 mm or 150 mm. To this was added the length of each end piece 22, 23, which in all cases was 125 mm. High speed trials produced with one exception exactly the same as the previous trials, i.e. 78.5 dB(A) with the dividing wall 21*b*, 77.5 dB(A) with 1=200 mm and 78.5 dB(A) with 1=150 mm. The embodiment according to FIG. 6A produced, however, significantly lower noise levels than the embodiments according to FIGS. 6B and 6C** for measurements at dock-side at lower engine speed. The exhaust counter pressure in all of the embodiments of the system according to the invention was, at most, 10 kPa, which is to be compared with 7 kPa for the known system described. Even if the difference in percent in the counter pressure appears to be relatively large, an increase in the counter pressure of 3 kPa is negligible in this context.

The embodiment with curved upper edges of the baffle elements 50, 51 together with the edge piece 63 has proved to provide approximately 2 dB(A) lower noise level than with a system with baffles corresponding to the baffles 50, 51, but which has completely flat upper edges and without a counterpart to the edge piece 63.

Even though the invention has been described above with reference to embodiments for engines with two rows of cylinders, it is obvious that a container of the type shown in FIG. 6C can be used together with engines with one row of cylinders.

As is evident from the figures, the inlet tube 26 is inclined somewhat relative to the horizontal plane. In the trials, this inclination was 20°. The expression "essentially horizontally" in the following patent claims should therefore encompass deviations of up to about 30° from the horizontal plane.

I claim:

1. Exhaust muffler for marine engines comprising a container with an inlet and an outlet for exhaust and cooling water, and with flow diverting means disposed between the inlet and outlet, the container (20) being arranged to be mounted with its longitudinal axis horizontal and transverse to the longitudinal axis of the engine, said inlet (26) being disposed adjacent one end of the container, the mixture of exhaust gas and water entering the muffler at least essentially horizontally and perpendicular to the longitudinal axis of the container, said flow diverting means (50, 51) diverting the mixture horizontally in one longitudinal direction of the container and then back in the opposite longitudinal direction of the container and then upwards and then downwards before reaching the outlet, the outlet being disposed adjacent the same said one end of the container as the inlet.

2. Exhaust muffler according to claim 1, wherein the inlet (26) and the outlet (27) are arranged in the lower portion of the container and the flow diverting means (50, 51) defines a passage (62) which directs the horizontally diverted mixture of gas and water, which has been led into the lower portion of the container, upwards to the upper portion of the container and downwards towards the outlet.

3. Exhaust muffler according to claim 1, wherein the container (20) is cylindrical and its length exceeds its diameter.

4. Exhaust muffler according to claim 1, wherein the container (20) has end walls, and adjacent at least one of said end walls, has said inlet (26) and said outlet (27) which are directed at least essentially in alignment with each other and perpendicular to the longitudinal axis of the container.

5. Exhaust muffler according to claim 4, wherein the inlet (26) and the outlet (27) are arranged in a cylindrical portion (24) of a separate end piece (22, 23; 36, 37) removable from the rest of the container; and that said flow diverting means are flow diverting baffle elements (50, 51) arranged in the end piece between the inlet and the outlet.

6. Exhaust muffler according to claim 5, wherein the end piece (22, 23; 36, 37) consists of rigid material, while the portion (21) of the container connected to the end piece consists of elastic material.

7. Exhaust muffler according to claim 4, wherein the flow diverting means comprise first and second baffle elements arranged in spaced relation between the inlet and the outlet, and together with one end wall (52) of the container and a cover plate (58) defining a passage, which in its lower portion is open towards the interior of the container, one baffle element (50) being so disposed in front of the inlet that the incoming mixture is diverted axially, while the other baffle element (51) is so disposed relative to the outlet (27) that the mixture in the container is forced out of the container via the passage.

8. Exhaust muffler according to claim 1 for an engine with two rows of cylinders, wherein the container (20) is elongated and is common to the two rows of cylinders and is provided with an inlet (20) for cooling water and exhaust gases from each cylinder row at or near each end of the container.

9. Exhaust muffler according to claim 8, wherein the container (20) consists of an elongated container portion (21) open at both ends and a pair of end pieces (22, 23; 36, 37) removably fixed to either end of the elongated container portion, each end piece having a said inlet (26) and outlet (27) and said flow diverting means comprise intermediate flow diverting baffle elements (50, 51).

10. Exhaust muffler according to claim 9, wherein the container (20) is cylindrical and its length substantially exceeds its diameter.

11. Exhaust muffler according to claim 10, wherein the ratio between the length and the diameter of the container is about 4:1.

* * * * *